US005914741A

United States Patent [19]

Snelling et al.

[11] Patent Number: 5,914,741

[45] Date of Patent: Jun. 22, 1999

[54] METHOD OF CREATING MULTIPLE ELECTROSTATIC LATENT IMAGES ON A PYROELECTRIC IMAGING MEMBER FOR SINGLE TRANSFER OF A DEVELOPED MULTIPLE LAYER IMAGE

[75] Inventors: Christopher Snelling, Penfield; Robert W. Gundlach, Victor, both of N.Y.

[73] Assignee: Xerox Corporation, Stamford, Conn.

[21] Appl. No.: 08/784,645

[22] Filed: Jan. 21, 1997

[51] Int. Cl.[6] ..... B41J 2/42; B41J 2/385; G03G 15/06; G03G 15/01

[52] U.S. Cl. ..... 347/117; 347/153; 347/158; 399/168; 399/223

[58] Field of Search ..... 347/141, 151, 347/153, 114, 115, 116, 118, 119; 399/223, 168, 170, 171; 310/800; 29/25.35; 250/338.3; 358/300

[56] References Cited

U.S. PATENT DOCUMENTS

| | | | |
|---|---|---|---|
| 4,078,929 | 3/1978 | Gundlach | 347/119 |
| 4,761,669 | 8/1988 | Langdon | 347/119 |
| 5,058,250 | 10/1991 | Turnbull | 310/800 |
| 5,153,615 | 10/1992 | Snelling | 347/114 |
| 5,185,619 | 2/1993 | Snelling | 347/114 |
| 5,537,198 | 7/1996 | Jackson | 399/168 |
| 5,557,393 | 9/1996 | Goodman | 399/223 |

OTHER PUBLICATIONS

Scharfe, Merlin "Electrophotography Principles and Optimization," Chapter 4, pp. 97–104, 1984.

*Primary Examiner*—N. Le
*Assistant Examiner*—L. Anderson
*Attorney, Agent, or Firm*—Michelle Waites

[57] ABSTRACT

A method and apparatus for reproducing color images using a non-interactive pyroelectric imaging process is disclosed. More specifically, the present invention is used to generate multiple layers of toner on the top surface of a pyroelectric imaging member without physical contact to the imaging member top surface. The ability to generate a composite image with different materials in this manner enables printing machines to use a pyroelectric imaging process to generate color images in the image on image (I-O-I) mode.

22 Claims, 4 Drawing Sheets

METHOD OF CREATING MULTIPLE ELECTROSTATIC LATENT IMAGES ON A PYROELECTRIC IMAGING MEMBER FOR SINGLE TRANSFER OF A DEVELOPED MULTIPLE LAYER IMAGE

The present invention is directed to a pyroelectric imaging process which allows development of multiple electrostatic charge patterns that can be used to create composite, multi-layer images. The invention can be used to reproduce color images by developing each charge pattern with different colored toner particles.

BACKGROUND OF THE INVENTION

The xerographic imaging process begins by charging a photoconducting imaging member to a uniform potential, and then projecting an image of an original document onto its surface. Projection of an original document onto the charged imaging member discharges the surface in areas corresponding to light reflecting, non-image areas in the original document while maintaining charge in the dark, image areas. This selective discharging process produces an electrostatic latent image of the original document on the surface of the imaging member. Developer material is then made available to the surface of the imaging member to transform the latent image into a visible reproduction. The developer typically consists of toner particles with an electrical polarity opposite that of the imaging member, which cause them to be naturally drawn to its still charged areas. A blank copy sheet is brought into contact with the imaging member and charged electrostatically to transfer the toner image to it. After removal from the imaging member, the copy sheet is heated, thereby permanently affixing the reproduced image to the sheet. This results in a "hard copy" reproduction of the original document. The imaging member is then cleaned to remove any residual developing material from its surface and is then exposed to light to prepare it for subsequent imaging cycles.

The most common type of imaging member is called a "photoreceptor." This device is made from a belt or drum coated with a photoconducting film. When a photoreceptor is provided, light from the image is projected from the original document onto the photoconductive surface, to discharge it in areas corresponding to non-image areas in the document. Although this is the most widely used type of imaging member, other types are available.

Specifically, a pyroreceptor is a belt or drum that has been manufactured from a pyroelectric material—one that changes electrical polarization as changes in its temperature take place. In a pyrographic printing machine of the present invention, imaging data is first transmitted to some type of thermal print stylus array, which transfers heat to the pyroreceptor in a pattern corresponding to the image on the original document. This creates an electrostatic net charge in the areas at which the stylus has contacted the pyroreceptor, but leaves no net charge in the areas which were not heated. Thus, an electrostatic latent image is generated on the pyroreceptor surface which can be developed with toner which is transferred and fused to copy media for reproduction of the original image.

Some advantages to using a pyroreceptor rather than a photoreceptor include extending the period of time during which the latent image will remain stable, thereby enabling image development to take place at leisure. Also, eliminating the requirement for a high voltage device to charge the imaging member provides a significant reduction in size, cost, and ozone generation. In addition, the linearity of the pyroelectric effect ($V_p \sim K_p \Delta t$ where $V_p$=potential, $K_p$=pyroelectric constant, $\Delta t$=temperature change) enables pyroelectric imaging methods to provide electrostatic latent images which produce gray level information in the form of absolute potential, or charge, levels. It is also possible to obtain precisely determined pyroreceptor surface potentials since charge is not transported through the pyroreceptor layer, as it is through a photoconductive layer. The presence and population state of traps in photoreceptors can significantly modify internal charge transport following exposure. Rapid dark discharges relative to system cycle times cause loss of contrast of the electrostatic latent image to be presented for development. Variations such as the amount of time the machine is actually in use, and photoreceptor aging effects further compound the difficulty of using xerographic photoreceptors to achieve adequate consistency in gray level imaging. Xerographic imaging is therefore usually restricted to a binary imaging format. Toner is either developed, or not developed, depending upon the magnitude of image potential (or charge) relative to a narrow threshold. The generation of gray scale output is achieved by halftone techniques which place a significant burden on system resolution requirements, and therefore, the scanning and modulation frequency requirements for digital imaging.

The following disclosures may be relevant to various aspects of the present invention:

U.S. Pat. No. 5,557,393 to Goodman issued Sep. 17, 1996 discloses a process and apparatus for achieving customer selectable colors in an electrostatographic imaging system. Among the compatible toner compositions that may be selected are toner compositions having blend compatibility components coated on an external surface of the toner particles and particulate toner compositions containing therein blend compatibility components or passivated pigments. Electrostatographic imaging devices, including a tri-level imaging device and a hybrid scavengeless development imaging device, are also provided for carrying out the described process. The processes and apparatus of the present invention are especially useful in imaging processes for producing single color or highlight color images using customer selectable colors, or for adding highlight color to a process color image produced by the same apparatus.

U.S. Pat. No. 5,185,619 to Snelling issued Feb. 9, 1993 discloses a method and apparatus for printing using a pyroelectric imaging member. The surface of the pyroelectric member is thermally exposed in a localized fashion while the surface charge is neutralized. The exposed surface of the imaging member is then cooled to generate an electrostatic latent image thereon. This latent image is developed with charged toner particles, which are transferred from the pyroelectric member to a substrate through the use of a second uniform thermal treatment which serves to reverse the net charge polarity of the imaging member and thereby reduces the electrostatic forces attracting the toner particles to the imaging member. The transferred toner image may be simultaneously or subsequently fixed to the substrate by a thermal or other well known fusing treatment.

U.S. Pat. No. 5,153,615 to Snelling issued Oct. 6, 1992 discloses a method and apparatus for printing including the use of a pyroelectric material in a novel fashion to directly mark an image on a print substrate. The image is produced by initially coating a poled pyroelectric material with a uniform coating of charged marking particles and subsequently thermally exposing the pyroelectric material in a localized fashion, thus reversing the polarity of the charge which repels the particles from the surface of the pyroelectric material, and onto the surface of a print substrate placed in close proximity thereto. Subsequently, the image formed by the transferred marking particles is fixed to the substrate by a thermal or other well known fusing treatment.

U.S. Pat. No. 5,537,198 to Jackson issued Jul. 16, 1996 discloses a method and apparatus for forming color images using "double split" recharging. A recharging step takes place between two image creation steps to recharge a charge retentive surface to a predetermined potential. Pursuant to forming the second of two images, a first corona generating device recharges the charge retentive surface with a direct current to a higher absolute potential than a predetermined potential. A second corona generating device recharges the charge retentive surface with a direct current to a lower absolute potential than the predetermined potential, and then a third corona generating device recharges the surface, also with a direct current, to the predetermined potential. An electrical charge associated with the first image is prevented from reversing its original polarity after being recharged by the third corona generating device, thereby preventing the occurrence of undercolor splatter of the toner image.

U.S. Pat. No. 4,078,929 to Gundlach issued Mar. 14, 1978 discloses a method for making electrostatic charge patterns and for developing such charge patterns in two colors. A charge pattern is generated with a single polarity but to at least three different levels of potential. The charge pattern is developed in two colors by utilizing relatively negatively charged toner particles of one color and relatively positively charged toner particles of a second color.

All of the references cited herein are incorporated by reference for their teachings.

Accordingly, a need remains for improved methods and apparatus for reproducing color images using a xerographic process. Further, there is a need for processes and apparatus for creating multiple latent images which can be superimposed on top of each other prior to transfer of the developed image to copy media.

SUMMARY OF THE INVENTION

In accordance with the present invention, there is provided an electrostatic printing apparatus, which includes: a pyroelectric imaging member having a first surface and a second surface; a transport device engaging said pyroelectric imaging member, to move said pyroelectric member along a path; a thermal activation device situated in said path to apply heat to said first surface in a pre-determined pattern, thereby generating an electrostatic potential pattern having a polarity, said electrostatic potential pattern corresponding to said pre-determined heat application pattern; a surface potential neutralizing device situated in said path and coupled to said second surface to deposit an induced electrostatic charge onto said second surface, said electrostatic charge having a polarity opposite that of said electrostatic pattern of surface potential, thereby neutralizing said electrostatic voltage pattern; at least one developing station situated along said path where a developing material is deposited onto said pyroelectric member after said pyroelectric member cools, to produce a developed image; and a transfer station where said developed image is transferred to a copy sheet.

In accordance with another aspect of the invention, there is provided a method of reproducing an image using an electrostatic printing apparatus, which includes: transporting a pyroelectric imaging member along a path; thermally activating a first surface of said pyroelectric imaging member at a thermal activation source situated along said path to create an electrostatic potential pattern on an opposing second surface, said electrostatic potential pattern having a polarity; neutralizing said electrostatic potential at said second surface with a voltage neutralizing charge source situated along said path; cooling said pyroelectric imaging member, thereby allowing said neutralizing charge to stabilize; moving said pyroelectric imaging member past at least one developing station situated along said path, and depositing a developer material thereon; and transferring said developed image to a copy sheet at an end of said path.

A non-interactive pyroelectric imaging process offers a valuable alternative to the electrophotographic imaging process. Advantages of this process include the ability to input imaging information via readily available and physically small thermal printheads; the ability to achieve high quality output without high resolution requirements demanded by halftone screening methods, as opposed to gray level ability; the ability to stack images without concern for light transmission through previously developed images; and the ability to use both liquid and dry developer materials.

BRIEF DESCRIPTION OF THE DRAWINGS

Other features and advantages of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

The present invention is directed to a pyroelectric imaging process which allows multiple images to be stacked on top of each other prior to transfer to copy media. Specifically the present invention relates to a method and apparatus for creating or reproducing color images by creating multiple latent electrostatic charge patterns and sequentially developing each with toner particles having different colors. This is followed by simultaneous transfer of the composite color image to its final media.

Figure 1:
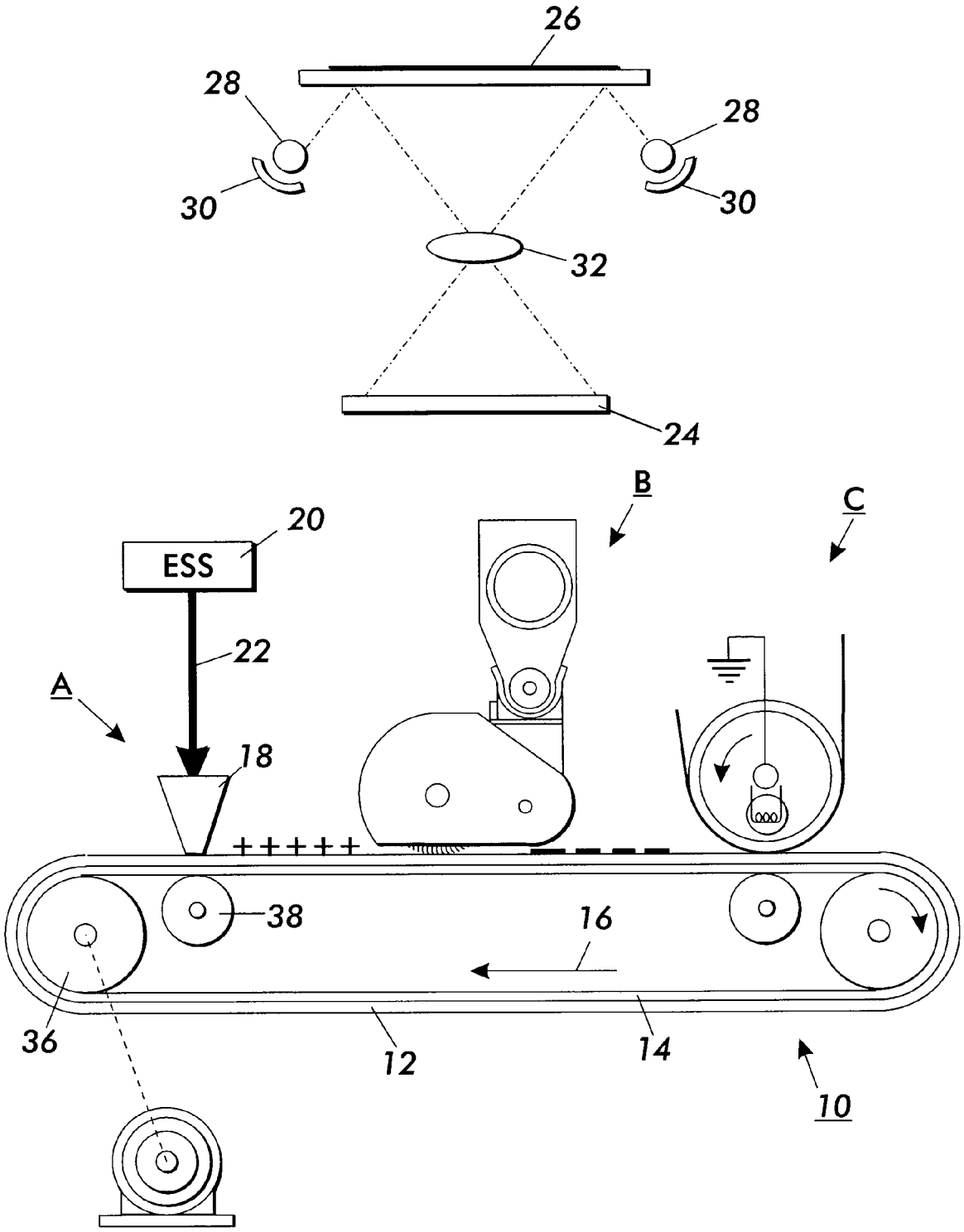
FIG. 1 PRIOR ART
FIG. 1 is a schematic elevational view of a multifunction printing machine incorporating the pyroreceptor of the present invention.

For a general understanding of a multi-functional printing machine, perhaps including printing, faxing, scanning, and/or copying functions in which the features of the present invention may be incorporated, reference is made to the drawings where the showings are for the purpose of describing an embodiment of the invention and not for limiting same. In the multi-functional printing machine illustrated in FIG. 1, a pyroreceptor 10 having a pyroelectrically responsive layer 12 and a conductive base layer 14, is rotated in the direction indicated by arrow 16 through the various processing stations for producing a copy of an original document. Initially, drive roll 36 is rotated to transport pyroreceptor 10 through writing station A, which employs thermal print stylus array 18, to selectively heat layer 12. Thermal coupling between pyroreceptor 10 and stylus array 18 is assured by pressure roll 38 which maintains a normal force on the rear of pyroreceptor 10. Thermal activation of pyroelectric layer 12 results in the generation of an induced electrostatic latent image on the surface of pyroreceptor 10.

Several devices, including an array typically used for the production of prints on thermally sensitive paper will be suitable for use as a thermal print stylus array 18. The individual elements of stylus array 18 are driven by electronic subsystem (ESS) 20, via input lines 22, in accordance with image data received from either a computer driven print source or from a commonly known charge coupled device (CCD) 24. The print source may be any suitable raster input generation system including computer generated and stored digital images, but non-array marking arrangements may also be possible. Likewise, CCD 24 is a well known rasterizing input device capable of generating a rasterized representation of an image contained on original document 26. More specifically, original document 26 is illuminated by lights 28 and reflectors 30, thereby causing light to be reflected from the surface of the document and through lens 32 which focuses the light onto CCD 24. Subsequently, the output of the individual sensors of CCD 24 is transferred to ESS 20 for output to thermal stylus 18, or optionally as electronic scan data. ESS 20 may also act as an image processing device, capable of correcting and/or modifying the input data in accordance with a set of pre-defined requirements.

Another way to selectively heat the pyroelectric imaging member is to employ a resistive ribbon substrate layer beneath pyroelectric layer 12 which, upon activation by point contact electrodes, will result in the necessary localized heating of the substrate and adjacent pyroeledric layer. This type of substrate would generally employ a pyroelectric top layer equivalent to layer 12, and an electrically conductive substrate layer on the bottom. Application of high current densities to the conductive substrate of pyroreceptor 10, via pin-type print head electrodes which press against the substrate, will result in highly localized heating above the electrodes and, thus, the simultaneous localized heating of the pyroelectric layer 12. In this type of system, the printhead electrodes replace support roll 38 depicted in FIG. 1.

Generally, the print head electrodes would be driven in a manner similar to the individual elements of stylus array 18, by a rasterized image data source, as previously described. The localized heating of the pyroelectric top layer would result in localized electrostatic charge patterns on the surface of the pyroelectric layer. This resultant surface potential would then be neutralized by induction of counter charge through grounding the surface against a conductive roll or similar means disposed upon the upper surface of pyroreceptor 10, (replacing heating stylus 18 illustrated in FIG. 1) which produces the latent image on the surface of pyroelectric member upon cooling. Pressing a conductive roll against the top surface of pyroreceptor 10 would also facilitate contact of the underside of pyroreceptor 10 with the array of point contact electrodes. This manner of producing highly localized heating enables pyroelectric layer 12 to be grounded, then cooled immediately, resulting in a longer lasting electrostatic latent image.

After the electrostatic latent image has been created, drive roll 36 will continue to rotate, and transport pyroreceptor 10 through development station B, where oppositely charged toner particles are deposited onto the latent image. This produces a developed image on the surface of pyroreceptor 10 which will progress toward transfer station C. While the latent image is being developed, a blank copy sheet will be removed from a paper storage tray and advanced to transfer station C, where the sheet will be placed in contact with the developed image, thereby causing transfer of the image to the copy sheet. The image will then be permanently fixed to the copy sheet, and the sheet will be removed from the surface of pyroreceptor 10, and transported to an output area of the printing machine. After the copy sheet has been removed from pyroreceptor 10, the pyroreceptor will move past cleaning and charge neutralizing stations (not shown) for removal of any remaining toner particles and preparation of the belt for subsequent imaging cycles.

While the precise mechanism of the generation of changes in electrical polarization by heating may not be fully understood, it is clear that thermal expansion of the spacing of permanent dipoles of charge throughout the bulk of the pyroelectric film increases the potential difference across the film. Thus, applying heat to the film while maintaining one surface at equipotential causes an increase of the potential of the second surface even though no net charge has been delivered. That increase in potential of the second surface will now induce the opposite polarity of charge from a lower voltage source, such as a resistive or conductive wire to ground.

Poled Polyvinylidine fluoride (PVDF) is one pyroelectric material that exhibits highly successful results when used with the present invention. PVDF is one type of copolymer that belongs to the class of chemicals commonly referred to as halogenated polymers. More specifically, PVDF falls within the group of fluorinated polymer chemicals. It exhibits a variety of mechanical and electrical properties, including pyroelectricity, piezoelectricity, and nonlinear optical properties. While the invention is known to be successful using PVDF, it is likely that other pyroelectric materials, including fluorinated polymers or other types of halogenated polymers may be used. Therefore, the invention is not limited to the use of poled PVDF. As indicated above, presently available pyroelectric imaging processes begin by locally heating a PVDF pyroreceptor. Heating of pyroreceptor 10 creates a difference in electrostatic potential between the underside and the top surface of the member. Electric current then flows by induction from the thermal stylus 18 to pyroreceptor 10, neutralizing its surface potential. Following this neutralization, and upon cooling of the PVDF film, a stable electrostatic latent image will remain on the surface of the pyroelectric imaging member. This latent image is equal in magnitude, but opposite in charge polarity, to the image originally created by the application of heat to the pyroelectric member. A process such as described above is generally referred to as a sequential pyroelectric imaging process. The term "sequential" refers to the fact that the steps of the pyroelectric process must occur in a specified sequence for generation of a stable latent image. Specifically, the process must begin by heating the pyroreceptor, which is followed by charge neutralization, and finally by cooling of the PVDF substrate. An electrostatic latent image that is generated using such a process typically has a slow charge decay rate. This allows development of the image with toner particles or other methods, to proceed at leisure.

Currently available processes for sequentially creating latent images are "interactive." That is, physical contact between the imaging member and the heated stylus must occur during each cycle in which a latent image is created. The present invention uses a "non-interactive" pyroelectric imaging process. It differs in that several layers of images may be created and developed with toner before a single transfer to the copy media takes place.

Figure 2:
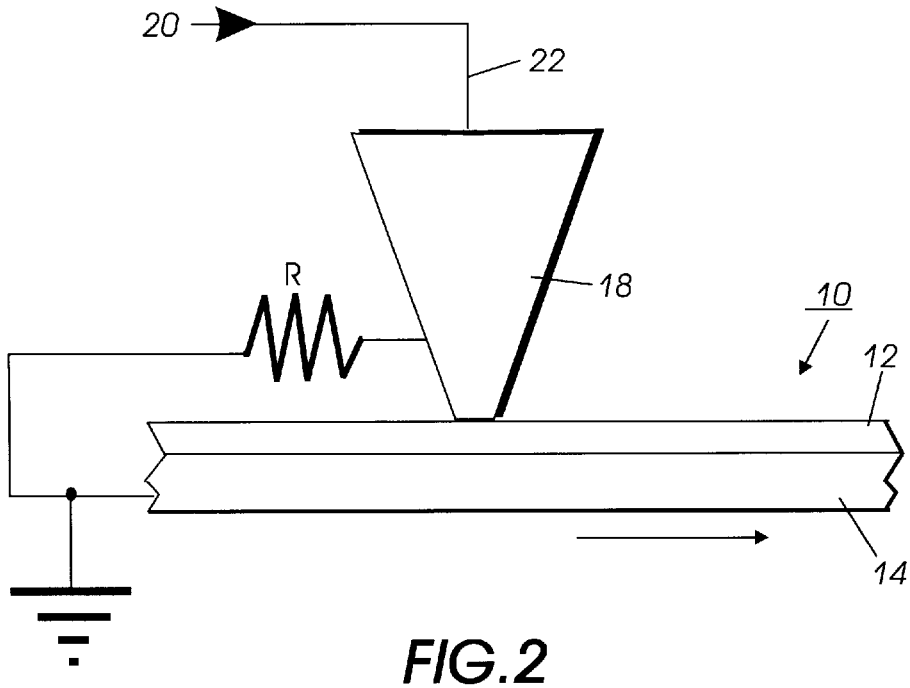
FIG.2 PRIOR ART
FIG. 2 is an equivalent circuit representation of the thermal print head and pyroelectric member known in the prior art.

Referring now to FIG. 2, the illustration depicts an interactive pyroelectric latent image creation process. As shown, imagewise heating of the pyroreceptor by thermal printhead 18 creates a surface potential which is neutralized by induced charge flow through R, the printhead leakage path to ground. The pyroreceptor is subsequently cooled, causing the latent image to emerge. As previously explained, this induced latent image is opposite in polarity to the initially thermally created surface potential and will retain its charge for an indefinite period of time. As indicated in the illustration, current processes of this type require both the thermal and electrical contacts to touch the top surface of pyroreceptor 10. In an apparatus such as the one shown, placement of thermal printhead 18 in contact with pyroreceptor 10 after the first latent electrostatic image has been created and developed with toner would destroy the developed image. The inability to have multiple contacts between the pyroreceptor and the heat source prevents the reproduction of color images, which requires building the composite color toner patterns on the pyroreceptor surface.

Color images are generated by mixing combinations of a set number of colorants. For example, colorants which include the three colors magenta, cyan, and yellow, may be combined with black to produce a large number of shades and colors. In an electrophotographic imaging process, color images using these three colors may be produced by creating one latent image which will be developed using magenta toner, then placing on top of it another latent image which will be developed using cyan toner, and then placing another latent image on top which will be developed using yellow toner and yet another using black toner. The most common color reproduction method is sequential development and transfer without intermediate contacting of the photoreceptor. Since stacking multiple images on a pyroreceptor has been impossible prior to the present invention, pyroelectric imaging methods have not been used to reproduce color images in the image on image (I-O-I) mode.

Figure 3:
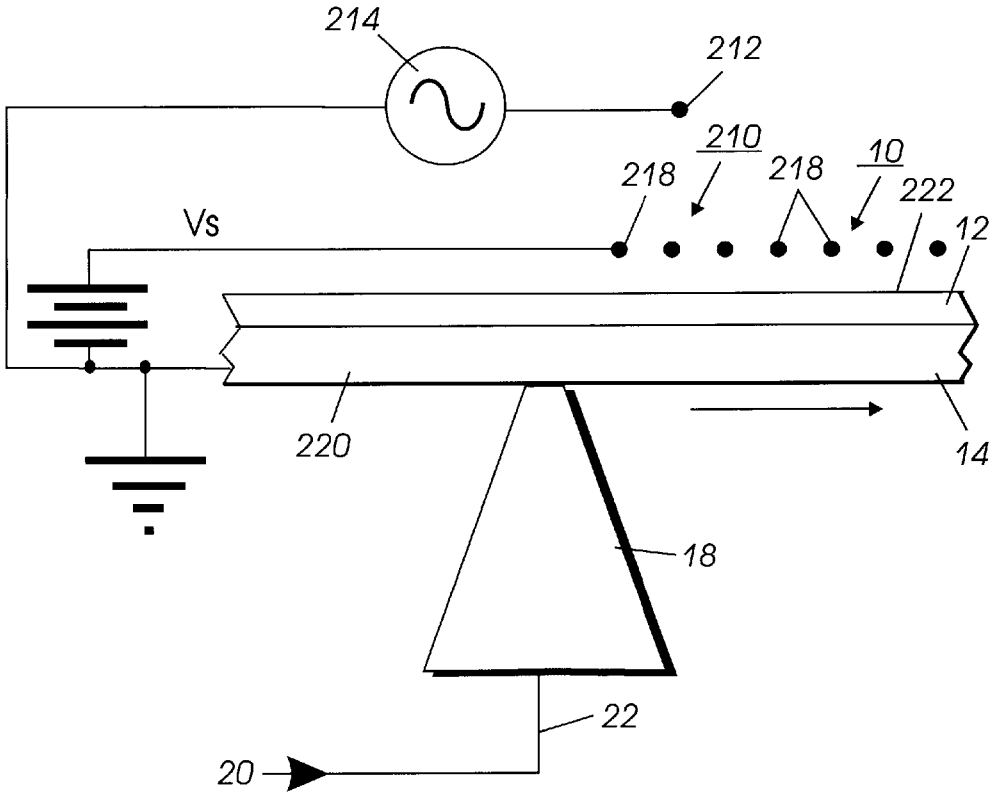
FIG. 3 is an equivalent circuit representation of the thermal print head and pyroelectric member disclosed by the present invention.

Referring now to FIG. 3, and in accordance with the present invention, thermal printhead 18 may be placed in contact with the bottom surface 220 of pyroreceptor 10 instead of the top surface 222. In addition corona device 210 provides ion "contact" with top surface 222 to perform the neutralization step of the sequential imaging process. This replaces resistor R, the printhead leakage path to ground.

A scorotron arrangement 210 is one type of corona device that may be used with the present invention. Generally speaking, a scorotron is a charging device which achieves uniform charging to a specific potential by using an electrically biased grid 218. A scorotron 210 is merely one type of corona device that may be used with the present invention. Those skilled in the art will recognize that many other known surface charging devices may be used to generate the desired charge on pyroreceptor 10. In the arrangement shown, an alternating current (AC) source 214 is applied to coronode 212. An AC corona is capable of neutralizing either charge polarity. Thus, the AC scorotron unit 210 initially used to selectively charge pyroreceptor 10 by induction might be used to neutralize the surface potential at ambient temperature for preparation of the pyroreceptor by erasure of residual images for subsequent imaging cycles.

Figure 4:
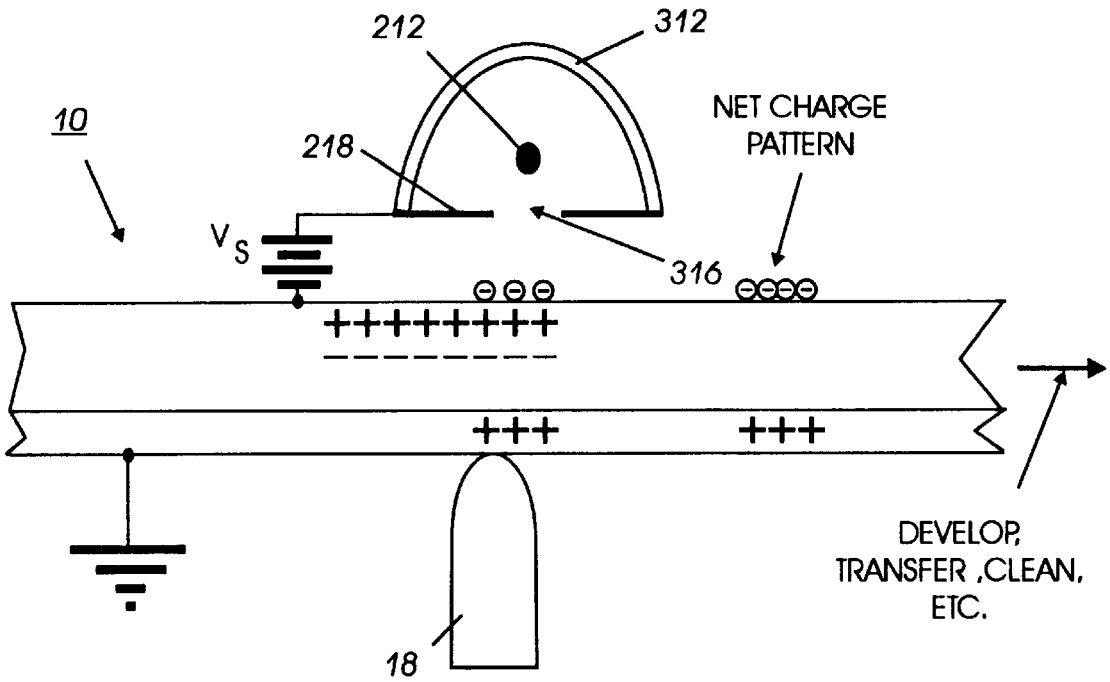
FIG. 4 is a schematic illustration of the imaging process of the present invention.

Referring now to FIG. 4, the details of the process used to create a latent image in accordance with the present invention will be described. The pyroelectric layer 12 represented here is a poled PVDF film which produces a net positive surface charge when heated by the thermal printhead with "Smart Heat," i.e. heat transferred to the pyroreceptor in a pattern which corresponds to the desired image output. Simply stated, Smart Heat is produced by activating thermal printhead 18 in response to ESS 20 which transforms the level of illumination reflected from the surface of an original document into a series of electronic signals. While the film is still hot the positive surface potential pattern is neutralized by induced negative charge from scorotron 312.

FIG. 4 also shows a direct current (DC) slit scorotron 312. This type of scorotron deposits negative charge onto the pyroreceptor to neutralize the positive surface potential pattern that was created by heating of pyroreceptor 10. DC slit scorotron 312 includes a slit 316 in D.C. biased reference electrode 218 through which the charge exits scorotron 312. Confining the charge to exit through a narrow slit limits the zone of surface potential neutralization to a narrow area. This area corresponds to the locations where heat resides prior to cooling of pyroreceptor 10. Upon cooling, the induced neutralization charge remains as a net negative charge image pattern for subsequent xerographic process steps.

Methods of reproducing color images typically require the creation and development of several electrostatic latent images. These methods may use either single pass or multiple or "multi" pass imaging systems. Color systems require the use of several development stations 420 as will be discussed with reference to FIGS. 5 and 6, rather than the single station B depicted in FIG. 1. One non-interactive development station must be provided for each color of toner particles that will be deposited onto the surface of charged pyroreceptor 10. A typical multi-pass electrophotographic system requires the imaging member to rotate past an imaging station, one time for each successive color image. The belt and developed image undergo a second revolution past all of the imaging stations so that a second latent electrostatic pattern will be created. Toner particles having a color different from those of the first developed image will be deposited onto the surface of the imaging member in this pass, leaving toner particles with two colors on the surface of the imaging member. The member will continue to revolve through the imaging station creating an additional latent image each time, and subsequently attracting toner particles with corresponding charges and different colors. The process will continue until the developed image contains an accurate representation of the original image.

In a multiple pass Image-On-Image (I-O-I) system, pyroreceptor 10 makes one complete rotation for each color of toner particle that will be deposited onto its surface. Once all latent images have been developed with the appropriate colors, the resulting composite image is transferred to the copy media. Repeating the charging and developing cycles causes multiple images to be placed on top of each other on the surface of an imaging member.

Figure 5:
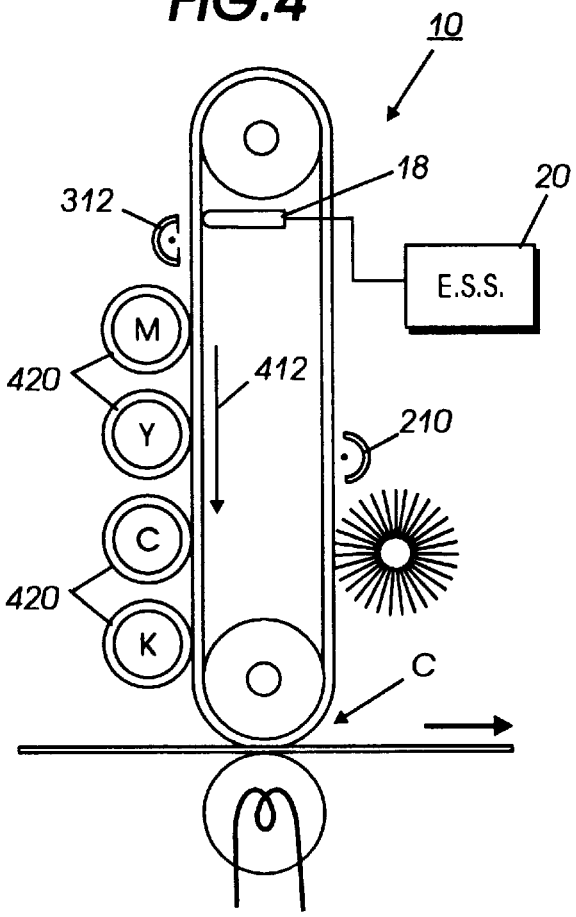
FIG. 5 represents a multi-pass xerographic printing system incorporating thrsent invention.

Referring now to FIG. 5, a multiple pass system incorporating the present invention is illustrated. As indicated, thermal printhead 18 is placed in contact with the underside of pyroreceptor 10, with DC slit scorotron 312 located on the other side. Pyroelectric imaging member 10 becomes electrostatically imaged and rotates in the direction of arrow 412 toward the non-interactive development sub-systems 420. In the embodiment shown, the first development sub-system 420 develops magenta toner, the second develops yellow toner, and the third cyan toner. The fourth developing station holds black particles, which can be the same as those used in black and white printing machines. This configuration is merely one example of the colors of toner particles which may be used and the order in which the developing stations may be placed in the printing machine, and the invention is not limited to this embodiment. Rotation of pyroreceptor 10 past thermal printhead 18 and induction charging slit scorotron 312 provides generation of the electrostatic latent image onto which magenta toner will be deposited. The pyroreceptor will then continue to rotate to bring the image up toward the thermal printhead which will heat the belt again to generate a second latent image. This image will subsequently be developed using yellow toner. Pyroreceptor 10 will then rotate back around past thermal printhead 18 for generation of a third latent image and subsequent development with cyan toner. Generation of a fourth image and development with black toner will complete the imaging process. While magenta, yellow, cyan and black particles will be deposited onto pyroreceptor 10, many colors will be present since the individual colors will become mixed together to create new colors. Once the last batch of toner particles has been deposited onto the pyroreceptor, the image will be transferred to a blank copy sheet at transfer station C.

A single pass electrophotographic printing system includes several imaging stations which are placed in line, each set to create electrostatic latent images on the surface of the photoreceptor. In contrast to a multiple pass system, a single pass printer undergoes repeated image charging and development with toner particles within a single revolution of pyroreceptor 10. This type of system is capable of producing images at a faster rate, since the machine only has to undergo one cycle in order to reproduce each full color image. However, single pass systems take up more space and require additional hardware—i.e. multiple thermal printheads and charge neutralization stations are required instead of one. The single pass system begins by activating the first imaging station and placing a desired electrostatic charge pattern onto the surface of the imaging member. Oppositely charged toner particles from the first development sub-system 420 are then deposited onto the latent image. The second imaging station is activated next to place a different latent image pattern onto the imaging member, and toner particles having a charge and color different from those in the first developing station are deposited onto the imaging member. This repeated imaging and depositing of toner particles continues until each imaging station has been activated and the appropriate collection of toner particles has been placed onto the imaging member to produce a developed image representative of the original color image.

Figure 6:
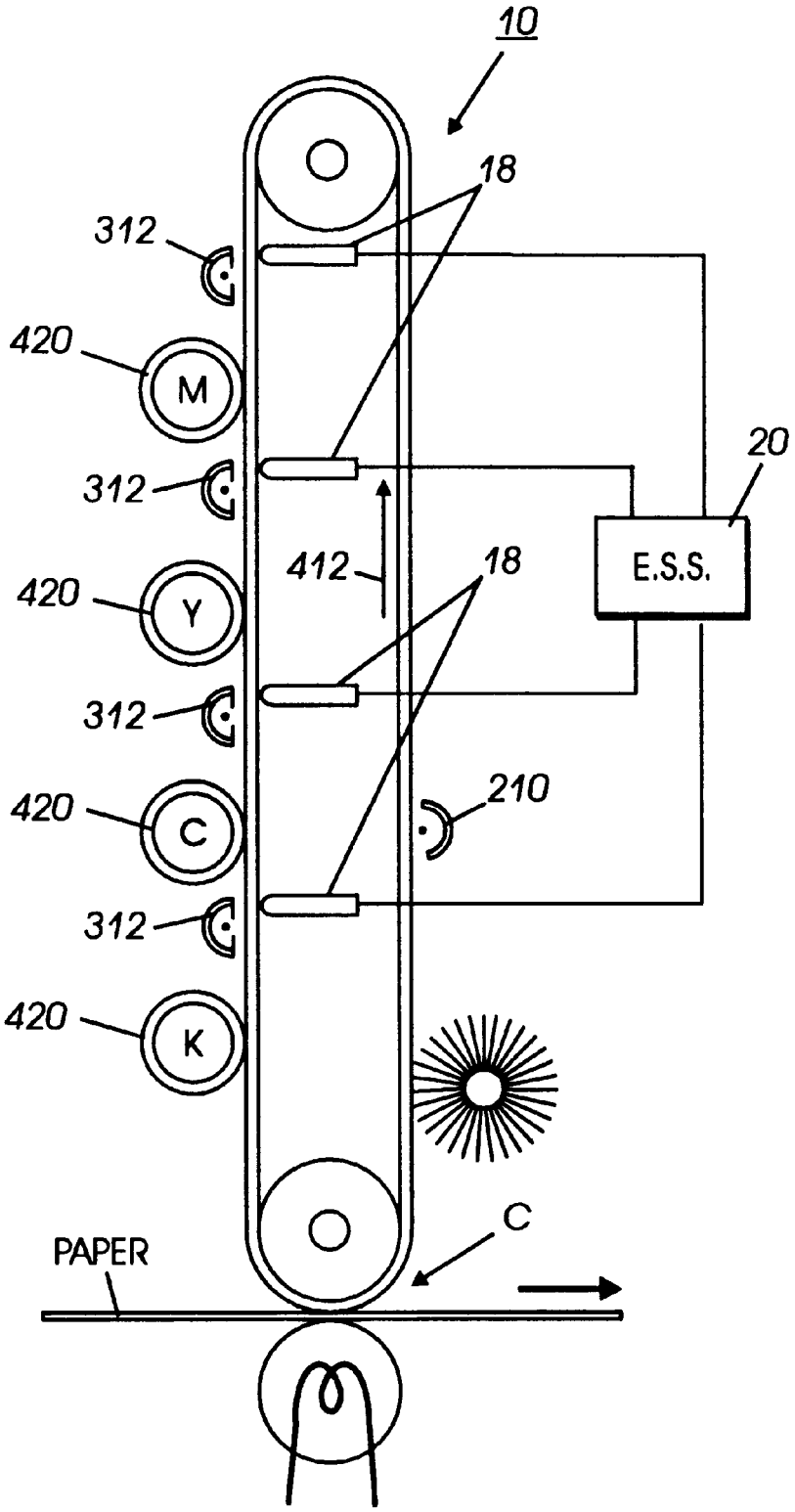
FIG. 6 is a schematic representation of a single pass xerographic system incorporating the present invention.

Referring now to FIG. 6, the drawing depicts a single pass printer incorporating the present invention. As shown, one thermal printhead 18 is located along the underside of pyroelectric imaging member 10 for each color that will be developed. A DC slit scorotron 312 sits immediately downstream from each printhead 18, on the opposite side of the pyroreceptor. In addition, one development sub-system 420 is present for toner particles having each of the various colors that will be used to develop images, in this case, magenta, yellow, cyan and black. Pyroreceptor 10 rotates in the direction of arrow 412, between thermal printhead 18 and DC slit scorotron 312, to create the first latent image, and oppositely charged magenta particles are deposited onto its surface further downstream from the printhead and after the image areas have cooled. The next latent image is then generated on the surface pyroreceptor 10, and oppositely charged yellow toner is deposited onto its surface. Another latent image is generated on pyroreceptor 10 at the third thermal printhead 18 and oppositely charged cyan particles are deposited on the belt. The final latent image is generated at the fourth thermal printhead 18 for deposit of black particles. Once the belt has moved past all developing stations, a blank copy sheet will be brought in contact with it at transfer station C for receipt of the developed image by electrostatic transfer means.

Although the systems illustrated in FIGS. 5 and 6 above each show four non-interactive development subsystems, fewer or more than four subsystems may be used as required by the user. In addition, development of the first latent image could be performed by conventional magnetic brush rather than by non-interactive (scavengeless) development which is essential for all subsequent development steps.

It is, therefore, apparent that there has been provided in accordance with the present invention, an apparatus for creating color images using a pyroelectric imaging process that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An electrostatic printing apparatus, comprising:

a) a pyroelectric imaging member having an imaging surface and a supporting surface;

b) a transport device engaging said pyroelectric imaging member, to move said pyroelectric member along a path;

c) a first thermal activation device situated in said path to apply heat to said supporting surface in a first pre-determined pattern, thereby generating a first electrostatic potential pattern on said imaging surface, wherein said first electrostatic potential pattern resides within an imaging area, and corresponds to said first pre-determined heat application pattern;

d) a first non-contacting surface potential neutralizing device situated in said path and coupled to said imaging surface without physically contacting said imaging area to deposit a first electrostatic charge onto said first electrostatic potential pattern, said first electrostatic charge having a polarity opposite that of said first electrostatic potential pattern, thereby neutralizing said first electrostatic potential pattern;

e) at least one next thermal activation device situated in said path to apply heat to said supporting surface in a next pre-determined pattern, thereby generating at least one next electrostatic potential pattern on said imaging surface, wherein said next electrostatic potential pattern resides within said imaging area, and corresponds to said next pre-determined heat application pattern;

f) at least one next non-contacting surface potential neutralizing device situated in said path and coupled to said imaging surface without physically contacting said imaging area to deposit a next induced electrostatic charge onto said next electrostatic potential pattern, said next electrostatic charge having a polarity opposite that of a next electrostatic potential pattern, thereby neutralizing said next electrostatic potential pattern;

g) a cooling device to reduce a temperature of said neutralized electrostatic potential patterns, thereby re-generating electrostatic potential patterns having a polarity opposite said electrostatic potential pattern polarities;

h) at least one developing station situated along said path where a developing material is deposited onto said re-generated electrostatic potential pattern after said pyroelectric member cools, to produce a developed image; and i) a transfer station where said developed image is transferred to a copy sheet.

2. An apparatus as claimed in claim 1 wherein said pyroelectric member is made from a pyroelectric material.

3. An apparatus as claimed in claim 2 wherein said pyroelectric material is a halogenated polymer.

4. An apparatus as claimed in claim 3 wherein said halogenated polymer is a fluorinated polymer.

5. An apparatus as claimed in claim 1 wherein said pyroelectric member is made from polyvinylidine fluoride.

6. An apparatus as claimed in claim 1 wherein said thermal activation device further comprises a thermal print stylus.

7. An apparatus as claimed in claim 1 wherein said surface potential neutralizing device is a corona device.

8. An apparatus as claimed in claim 7 wherein said corona device is a scorotron.

9. An apparatus as claimed in claim 1 wherein an alternating current source controls a current flow through said surface potential neutralizing device.

10. An apparatus as claimed in claim 1 including at least three developing stations situated along said path, each developing station containing a developer material with a different colorant.

11. An apparatus as claimed in claim 10 wherein said transport device moves said imaging area through said path a plurality of times, each time causing said electrostatic potential pattern to receive toner particles from a different developing station.

12. An apparatus as claimed in claim 10 further comprising a plurality of thermal activation devices, one thermal activation device associated with each of said development stations, each of said thermal activation devices applying heat to said imaging area before said imaging area reaches said associated developing station.

13. A method of reproducing an image using an electrostatic printing apparatus, comprising:

a) transporting a pyroelectric imaging member along a path;

b) thermally activating a supporting surface of said pyroelectric imaging member at a first thermal activation source situated along said path to create a first electrostatic potential pattern in an imaging area on an imaging surface of said pyroelectric imaging member;

c) neutralizing said first electrostatic potential pattern with a non-contacting voltage neutralizing charge source situated along said path, wherein said non-contacting voltage neutralizing charge source deposits an electrostatic charge opposite in polarity to an electrostatic potential pattern polarity without making physical contact with said imaging surface;

d) thermally activating said supporting surface a thermal activation source situated further in a process direction along said path than said first thermal activation source to create a next electrostatic potential pattern in an imaging area on said imaging surface;

e) neutralizing said next electrostatic potential pattern with a next non-contacting voltage neutralizing charge source situated along said path, wherein said non-contacting voltage neutralizing charge source deposits an electrostatic charge opposite in polarity to said next electrostatic potential pattern polarity without making physical contact with said imagine surface;

f) cooling said pyroelectric imaging member, thereby allowing said neutralizing charge to stabilize;

g) moving said imaging area past at least one developing station situated along said path, and depositing a developer material contained in said developing stations thereon; and h) transferring said developed image to a copy sheet at an end of said path after development of at least two electrostatic patterns.

14. A method as claimed in claim 13 wherein said pyroelectric imaging member is made from a halogenated polymer.

15. A method as claimed in claim 14 wherein said halogenated polymer is a fluorinated polymer.

16. A method as claimed in claim 13 wherein said pyroelectric imaging member is made from polyvinylidine fluoride.

17. A method as claimed in claim 13 wherein said thermally activating step further comprises:

a) reflecting light from an original image;

b) converting an intensity of said reflected light to electronic signals in a pattern determined by said light contained in said original image;

c) transmitting said electronic signals to a thermal activation device; and d) transferring heat from said thermal activation device to said first pyroreceptor surface corresponding to said pattern.

18. A method as claimed in claim 13 further comprising transporting said imaging area past a plurality of developing stations situated along said path, each developing station containing a developer material having a different colorant.

19. A method as claimed in claim 18 wherein said transporting step further comprises moving said imaging area through said path a plurality of times prior to initiating said transferring step.

20. A method as claimed in claim 18 wherein a plurality of thermal activation devices have been placed in said path, one thermal activation device associated with each of said developing stations.

21. A method as claimed in claim 20 further comprising:

a) sequentially activating each of said thermal activation devices, said activation causing heat to be applied to said imaging area, thereby generating an electrostatic charge pattern; and b) following each of said sequential activation steps, developing said electrostatic charge pattern at said associated developing station.

22. A method as claimed in claim 13 wherein said developed image is transferred to said copy sheet by electrostatic fields.

* * * * *